United States Patent [19]

Bertrams et al.

[11] Patent Number: 4,608,816

[45] Date of Patent: Sep. 2, 1986

[54] DEVICE FOR DOSING AND INJECTING A SMALL QUANTITY OF LIQUID INTO THE SPLICING AIR OF A PNEUMATIC YARN SPLICING DEVICE

[75] Inventors: Josef Bertrams, Wegberg; Edmund Wey, Nettetal, both of Fed. Rep. of Germany

[73] Assignee: W. Schlafhorst & Co., Monchen-Gladbach, Fed. Rep. of Germany

[21] Appl. No.: 626,408

[22] Filed: Jun. 29, 1984

[30] Foreign Application Priority Data

Jul. 2, 1983 [DE] Fed. Rep. of Germany ..... 3323892

[51] Int. Cl.[4] ..... D01H 15/00

[52] U.S. Cl. ..... 57/22

[58] Field of Search ..... 57/22, 297; 239/DIG. 14

[56] References Cited

U.S. PATENT DOCUMENTS

| | | | |
|---|---|---|---|
| 2,629,539 | 2/1953 | Drewes | 239/DIG. 14 X |
| 3,070,947 | 1/1963 | Toledo et al. | 57/22 |
| 3,474,615 | 10/1969 | Irwin et al. | 57/22 X |
| 3,599,868 | 8/1971 | Lombard | 239/DIG. 14 X |
| 3,643,417 | 2/1972 | Irwin | 57/22 X |
| 4,405,088 | 9/1983 | Gray | 239/DIG. 14 X |

*Primary Examiner*—Donald Watkins

*Attorney, Agent, or Firm*—Herbert L. Lerner; Laurence A. Greenberg

[57] ABSTRACT

The compressed-air pipe (20) leading to the splicing chamber (1) of the yarn splicing device encloses a humidification tube (30) which opens into this compressed-air pipe and which proceeds from a container filled with liquid (24) in which the liquid level is below the aperture (5) of the splicing chamber (1).

2 Claims, 3 Drawing Figures

Figure 1:
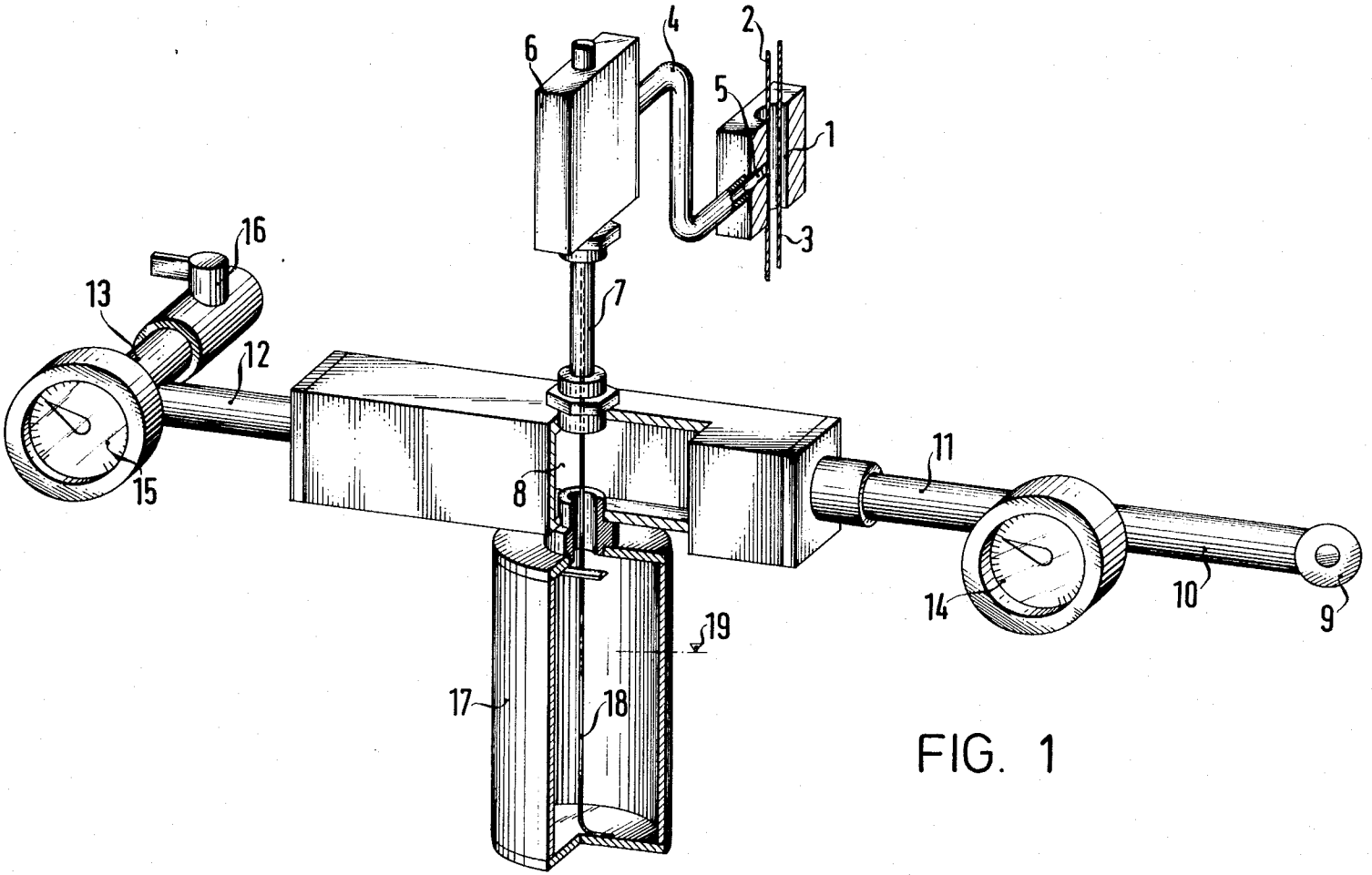

DEVICE FOR DOSING AND INJECTING A SMALL QUANTITY OF LIQUID INTO THE SPLICING AIR OF A PNEUMATIC YARN SPLICING DEVICE

The invention refers to a device for dosing and injecting a small quantity of liquid into the splicing air of a pneumatic yarn splicing device.

As is known, the purpose of pneumatic yarn splicing devices is to join together two or more yarn ends by loosening the fibres in the yarns and joining the fibres thus loosened of the two yarns with a splice through one or several blasts of compressed air. To make for better splicing and to make such spliced joints stronger and better in visual appearance, a small quantity of liquid can be added to the splicing air. The problem attached to this is, to dose this small quantity of liquid very accurately, to atomize it and to get it in the dosed quantity, and optimally distributed in the splicing air, into the splicing chamber of the pneumatic yarn splicing device.

The object of this invention is to introduce in a simple way, at the moment of splicing and as a function of the duration of the compressed-air blast, a very accurately dosable small quantity of liquid well distributed into the compressed air used for the splicing. According to the invention this object is achieved by the fact that the compressed-air pipe leading to the yarn splicing chamber of the yarn splicing device encloses a humidification tube opening into this compressed-air pipe and proceeding from a container filled with liquid in which the liquid level is below the aperture of the splicing chamber.

The advantages obtained from the invention lie particularly in the fact that it not only achieves a very accurate dosage and good atomization of the dosed small quantity of liquid, but, in addition, also makes sure that the forming of the mixture is well timed and that, above all, the quantity of liquid is adjusted to the duration of the compressed-air blast. With this, no time and opportunity is left for the components to dissociate.

Preferable configurations of the invention are described in the subclaims.

As a cosequence of the quantity of liquid desired for splicing being very small in relation to the quantity of compressed air, the humidification tube preferably takes the form of a capillary tube. After the splicing process, a sufficient quantity of liquid remains in the capillary tube and need not, therefore, be transported up from the liquid container.

If the humidification tube opens into the compressed-air pipe before a controllable compressed-air dosing-valve, this compressed-air dosing-valve enhances the mixing and intermingling of the components. If, however, the compressed-air pipe between the compressed-air dosing-valve and the splicing chamber is not too short, it may also be expedient to have the mouth of the humidification tube located between the compressed-air dosing-valve and the splicing chamber. In that case, the compressed-air dosing-valve is loaded with dry air only, which also benefits the longevity of the compressed-air dosing valve.

The dosage is determined also by the length and diameter of the humidification tube. So as not to be under any limitation in this respect, it is of great advantage to provide the humidification tube with a check-valve. The humidification tube can, by way of example, be immersed in the liquid contained in the liquid container below the liquid level, and be fitted with a check-valve right at its mouth. In that case, after the initial atomization process, the liquid remains in the humidification tube and does not sink back to the level of the liquid in the container.

For the dosing of the liquid it can thus be expected that the humidification tube, depending on its position in the system, is filled with liquid right up to its outlet.

Examples of possible configurations of the invention are illustrated in the drawings. By reference to these examples, the invention is hereinafter described and explained in more detail.

Figure 2:
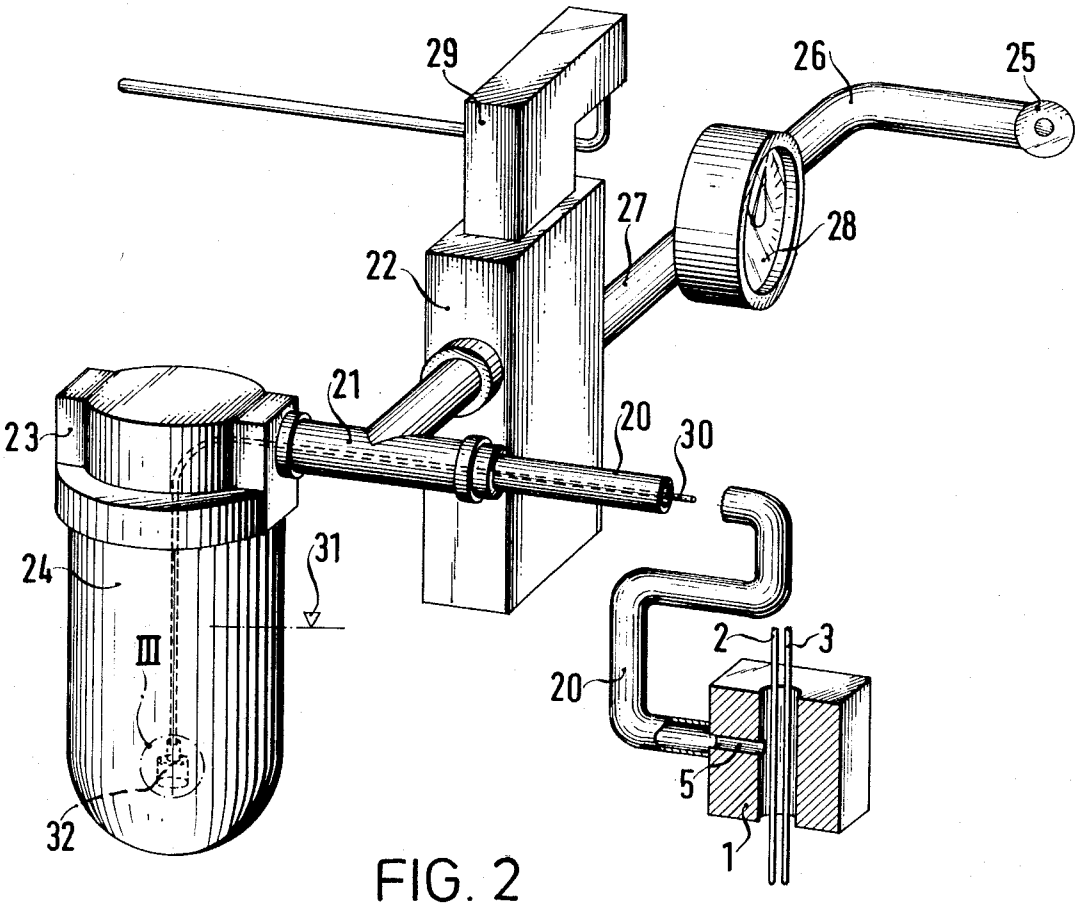

FIG. 1 shows an example of a first possible configuration,

FIG. 2 an example of a second possible configuration of the invention.

Figure 3:
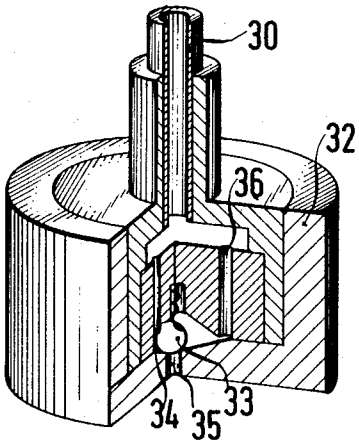

FIG. 3 contains a detail of the example shown in FIG. 2.

In the first example of a possible configuration of the invention according to FIG. 1, a pneumatic yarn splicing device, of which not all the details are shown in the drawing, includes among other things a splicing chamber 1, which in this example has received two yarn ends 2 and 3 to be joined together with a splice. The end of the pipe 4 joins the splicing chamber 1 at an aperture 5. The pipe 4 proceeds from an electromagnetic compressed-air dosing-valve 6 which is connected to a compressed-air pipe 7. The compressed-air pipe 7 proceeds from a horizontally arranged channel 8, which, for example, could keep more than one pneumatic splicing device supplied with compressed air at a time. The channel 8 is fed with compressed air from a compressed-air supply.

From the compressed-air supply 9 a pipe 10 leads to compressed-air regulating valve 14. The compressed-air regulating valve 14 is connected with the channel 8 through a pipe 11. From the opposite end of the channel 8, a pipe 12 leads to another compressed-air regulating valve 15. The outlet of the compressed-air regulating valve 15 is connected through a pipe 13 with a adjustable choker-valve 16, which has its outlet into the open air.

When the compressed-air regulating valves and the choker valve are properly regulated, the air pressure inside the channel 8 is of the dimension desired.

The compressed-air pipe 7 includes a humidification tube 18 opening into said compressed-air pipe and proceeding from a container filled with liquid 17. The container 17 is connected to the channel 8 from below. The humidification tube 7 takes the form of a capillary tube. As can be seen from FIG. 1, the humidification tube 18 extends into the liquid container 17 and is immersed into the liquid with its mouth below the liquid level 19. The outlet opening of the humidification tube 18 is located a short distance before the controllable compressed-air dosing-valve 6.

The timing and the duration of the splicing process is determined by the compressed-air dosing-valve 6. As the compressed-air dosing-valve 6 opens, a current of air sets in flowing through the pipes 4 and 6 in the direction of the splicing chamber 1 and dragging along the liquid out of the humidification tube 18 during which process the liquid is atomized. When the air current ceases, the extraction of liquid also is stopped.

In the second example of a possible configuration of the invention, the splicing chamber is joined through a compressed-air pipe 20 to a T-shaped pipe joint 21. The T-shaped pipe joint 21 is connected at its one side with a compressed-air dosing-valve 22 and at its other side with the lid 23 of a container 24 filled with liquid.

On the supply side, there is a connection from a compressed-air supply 25 through a pipe 26, a compressed-air regulating valve 28 and a pipe 27, to the compressed-air dosing-valve 22.

The compressed-air dosing-valve 22 can be opened for short time-intervals, if necessary, two or three times in rapid succession, by an electromagnetic drive mechanism 29 for the purpose of splicing.

The compressed-air pipe 20 encloses a humidification tube 30 which opens into this compressed-air pipe. The humidification tube 30 also goes through the T-shaped pipe joint 21, then turns downward to join a check valve 32, below the liquid level 31, details of which can be seen in FIG. 3. The check-valve 32 comprises a ball 33 which due to the effect of gravity rests on a valve seat 34 thereby closing an opening 35 in its bottom.

When the compressed-air valve 22 is actuated, the compressed air flows through the compressed-air pipe 20 in the direction of the splicing chamber 1, thereby dragging along the liquid contained in the humidification tube, which causes the ball 33 to be lifted from the valve seat 34 allowing the liquid to flow in through the inlet channels 36 in the check-valve 32.

If the humidification tube 30 is not a capillary tube, it is expedient to slant the compressed-air pipe slightly on its way upward to prevent liquid trickling through or flowing out of the humidification tube.

The invention is not limited to the examples of possible forms and configurations depicted and described in the foregoing. It may prove expedient, for example, to introduce in a humidification pipe of relatively large diameter special means for obstructing the flow of the liquid, or to obtain by force a capillary effect by the insertion of a wick.

In the above examples of possible configurations, water has been used for the humidification. Special agents can be added to the water to enhance the safety of splicing.

We claim:

1. Device for dosing and injecting a small quantity of liquid into the splicing air leading to an aperture in the splicing chamber of a pneumatic yarn splicing device, comprising a compressed-air pipe connected to the aperture in the splicing chamber, a container connected to said compressed air-pipe, a humidification tube being partially disposed in said compressed-air pipe and having an inlet in said container and an outlet above said inlet in said compressed-air pipe, a liquid disposed in said container up to a liquid level below said outlet of said humidification tube, and a check valve connected to said inlet of said humidification tube.

2. Device as described in claim 1, wherein said humidification tube is a capillary tube.

* * * * *